US005170504A

United States Patent [19]

Nierhaus

[11] Patent Number: 5,170,504

[45] Date of Patent: Dec. 15, 1992

[54] KNEEPAD

[76] Inventor: Wolfgang Nierhaus, Herforderstrasse 147, W-4902 Bad Sulzuflen, Fed. Rep. of Germany

[21] Appl. No.: 858,560

[22] Filed: Mar. 27, 1992

[30] Foreign Application Priority Data

Mar. 30, 1991 [DE] Fed. Rep. of Germany ... 9103918[U]

[51] Int. Cl.[5] ..... A41D 13/00

[52] U.S. Cl. ..... 2/24; 2/267; 2/338

[58] Field of Search ..... 2/2, 2.5, 16, 22, 23, 2/24, 46, 267, 268, 311, 312, 338, 421, 450, 452; 24/198, 200

[56] References Cited

U.S. PATENT DOCUMENTS

| | | | |
|---|---|---|---|
| 1,449,656 | 3/1923 | Compton | 2/24 |
| 1,452,360 | 4/1923 | Clarke | 2/24 |
| 2,363,058 | 11/1944 | Gill | 2/24 |
| 5,031,240 | 7/1991 | Nierhaus | 1/1 |

FOREIGN PATENT DOCUMENTS

| | | | |
|---|---|---|---|
| 1104466 | 4/1961 | Fed. Rep. of Germany | 2/24 |
| 2710430 | 9/1978 | Fed. Rep. of Germany | 1/1 |
| 3517824 | 11/1986 | Fed. Rep. of Germany | 2/24 |
| 3804504 | 8/1989 | Fed. Rep. of Germany | 2/24 |
| 504288 | 4/1939 | United Kingdom | 2/24 |
| 1560622 | 2/1980 | United Kingdom | 2/16 |

*Primary Examiner*—Werner H. Schroeder
*Assistant Examiner*—Jeanette E. Chapman
*Attorney, Agent, or Firm*—Robert W. Becker & Associates

[57] ABSTRACT

A kneepad has a shell of soft rubber material with two sidewalls and a forward cup-shaped portion with respective inner sidewall surfaces, outer sidewall surfaces and upper edges. The sidewalls have a thickened portion with a slot. A padding of foamed rubber material extends over the entire inner surface area of the shell and is fixedly connected thereto by gluing. The padding has cutouts in the area of the slots, whereby these cutouts extend to the upper edges. A retaining strap penetrates the slots and forms loops to fasten the retaining strip to the kneepad. The inwardly oriented portion of the loops rests at the inner sidewall surfaces of the shell in the area of the cutouts and the outwardly oriented portions of the loops rest a the thickened portion of the sidewalls. The thickened portion extends outwardly and has a width which is approximately twice the wall thickness of the shell.

4 Claims, 1 Drawing Sheet

KNEEPAD

BACKGROUND OF THE INVENTION

The present invention relates to a kneepad for miners, gardeners, construction workers etc. The kneepad has a shell enclosing the knee from three sides whereby the shell is made of soft rubber or rubber-like plastic material. The shell is fastened to the knee by a retaining strap the ends of which penetrate the sidewalls of the shell at both sides of the knee. The interior of the shell is provided with a padding made of foamed rubber.

It is an object of the present invention to provide a kneepad in which the retaining strap is fastened in a manner which prevents it from being torn out of the respective fastening means and in which the padding is provided over a maximum portion of the inner surface area of the shell.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

The kneepad of the present invention is primarily characterized by a shell of soft rubber material having two sidewalls and a forward cup-shaped portion with respective inner slidell surfaces, outer sidewall surfaces and upper edges, the sidewalls having a thickened portion with a slot: a padding of foamed rubber material extending over the entire surface area of the inner sidewall surfaces and being fixedly connected to the inner sidewall surfaces, the padding having cutouts in the area of the slots, the cutouts extending to the upper edges; and a retaining strap penetrating the slots and forming loops to fasten the retaining strap to the kneepad, with an inwardly oriented portion of the loops resting at the inner sidewall surfaces in the area of the cutouts and with an outwardly oriented portion of the loops resting at the thickened portion.

It is especially advantageous that the thickened portion has a width corresponding to twice the width of the shell. This results on the one hand in the desired reinforcement, and, on the other hand, still allows for a sufficient elastic deformability of the shell.

It is expedient that the slots are essentially parallel to the upper edges of the sidewalls. It is furthermore expedient that the thickened portion projects outwardly.

DESCRIPTION OF PREFERRED EMBODIMENTS

Figure 1:
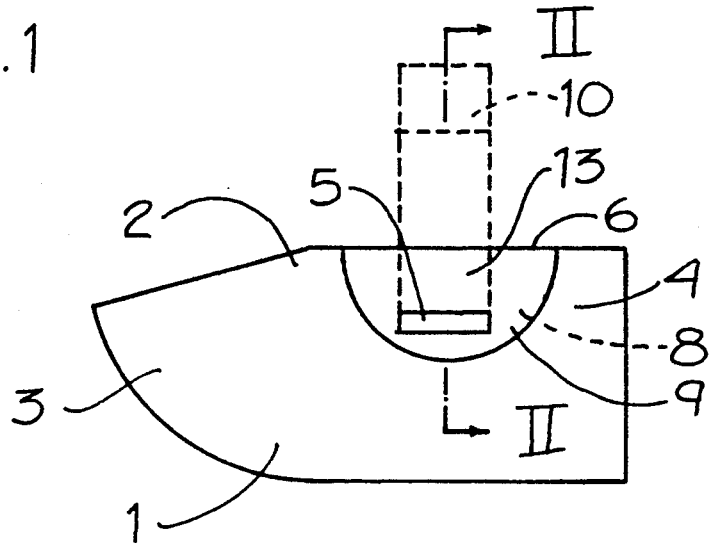
FIG. 1 shows a kneepad in a side view.

The present invention will now be described in detail with the aid of a specific embodiment utilizing FIGS. 1 through 3.

The shell 1 has a curved cross-section with two oppositely arranged sidewalls 2 which extend at both sides of the knee, respectively, the shin bone of the user and further has a cup-shaped portion extending in an upward direction and providing support for the kneecap. This cup-shaped portion is referenced with numeral 3. The upper end sections of the side walls 2 are designated by numeral 4 and have a slot 5 extending parallel to the upper edges 6 at a distance therefrom.

The inner sidewall surfaces of the shell 1 are provided with a thick padding 7 which is glued thereto. Usually, the padding 7 is approximately 4 to 6 times thicker than the shell 1 and fixedly glued thereto. In the area of the slots 5, the padding 7 has a cutout 8 of an essentially semicircular shape which extends to, respectively, is open in the direction of the upper edge 6.

Furthermore, the end section 4 of the sidewalls 2 are thickened in an outward direction. These thicker portions 9 surrounds the slots 5 and extend to the upper edges 6 The thicker portion 9 is designed such that within the area of the slot 5 the wall thickness of the shell 1 is approximately twice as great as the wall thickness in the remaining shell portions.

Figure 2:
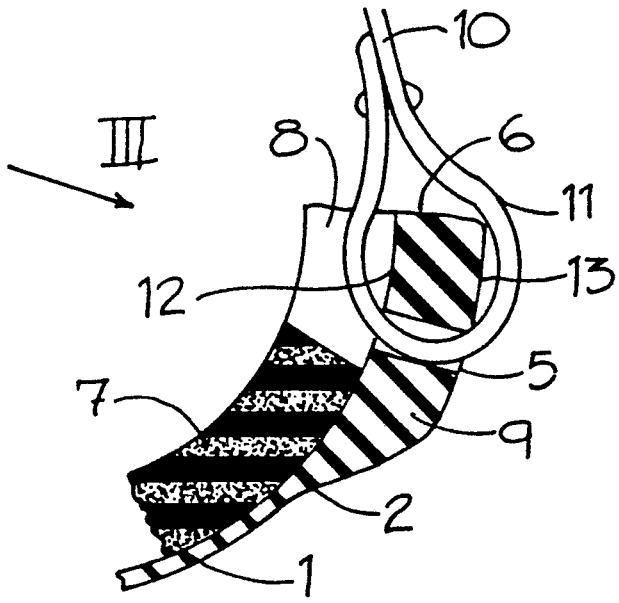
FIG. 2 shows a sectioned view of a portion of the kneepad according to FIG. 1 along the line II—II.
Figure 3:
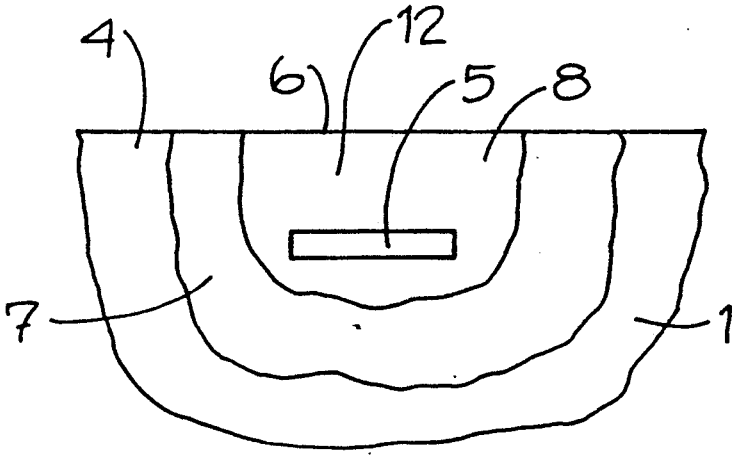
FIG. 3 shows a detailed view of the kneepad in the direction of arrow III of FIG. 2.

As can be seen in FIG. 2, a retaining strap 10 is guided through the slots 5. The retaining strap 10 forms loops 11 which with their inner portion rest at the inner sidewall surface 12 and with their outer portions rests at the outer sidewall surface 13 of the thickened portion 9.

Due to the inventive fastening of the retaining strap 10, the elasticity of the kneepad is maintained, the fastening, however, is essentially resistant to tearing and, furthermore, the fastening location, due to the cutouts 8, will not result in pressure points causing discomfort.

The present invention is, of course, in no way restricted to the specific disclosure of the specification and drawings, but also encompasses any modifications within the scope of the appended claims.

What I claim is:

1. A kneepad comprising:

a shell of soft rubber material having two sidewalls and a forward cup-shaped portion with respective inner sidewall surfaces outer sidewall surfaces and upper edges, said sidewalls having a thickened portion with a slot;

a padding of foamed rubber material extending over the entire surface area of said inner sidewall surfaces and being fixedly connected to said inner sidewall surfaces, said padding having cutouts in the area of said slots, said cutouts extending to said upper edges; and a retaining strap penetrating said slots and forming loops to fasten said retaining strap to said kneepad, with an inwardly oriented portion of said loops resting at said inner sidewall surfaces in the area of said cutouts and with an outwardly oriented portion of said loops resting at said thickened portion.

2. A kneepad according to claim 1, wherein said thickened portion has a wall thickness corresponding to twice a wall thickness of said shell.

3. A kneepad according to claim 1, wherein said slots are essentially parallel to said upper edges of said sidewalls.

4. A kneepad according to claim 1, wherein said thickened portion projects outwardly.

* * * * *